US006612441B2

(12) United States Patent
Lang et al.

(10) Patent No.: US 6,612,441 B2
(45) Date of Patent: Sep. 2, 2003

(54) KNOCK DOWN CONTAINER WITH INTEGRAL WALL

(75) Inventors: Eric D. Lang, Monroe, MI (US); Bernhard Friedrich Reumuller, Grosse Ile, MI (US)

(73) Assignee: Ace Packaging Systems, Inc., Monroe, MI (US)

( * ) Notice: Subject to any disclaimer, the term of this patent is extended or adjusted under 35 U.S.C. 154(b) by 59 days.

(21) Appl. No.: 10/006,498

(22) Filed: Dec. 3, 2001

(65) Prior Publication Data

US 2003/0102248 A1 Jun. 5, 2003

(51) Int. Cl.[7] ..... B65D 19/00
(52) U.S. Cl. ..... 206/600
(58) Field of Search ..... 206/386, 598, 206/596, 599, 600; 220/4.28–4.33, 6, 7; 229/125.37, 125.39, 125.41

(56) References Cited

U.S. PATENT DOCUMENTS 1,828,088 A 10/1931 Robinson
2,942,749 A * 6/1960 Rosenberg ..... 220/4.28
3,572,535 A 3/1971 Kinzie
3,819,079 A 6/1974 Levens
3,966,285 A * 6/1976 Porch et al. ..... 312/265.4
4,960,223 A 10/1990 Chiang et al.
5,110,037 A 5/1992 Pieritz, Sr.
5,507,237 A 4/1996 Barrow et al.
5,562,224 A * 10/1996 Pascal et al. ..... 220/4.33
5,609,111 A 3/1997 Hasegawa et al.
5,743,461 A 4/1998 Timmins
5,826,721 A 10/1998 Fukimoto et al.
5,855,291 A 1/1999 Ingle

* cited by examiner

*Primary Examiner*—Shian Luong
(74) *Attorney, Agent, or Firm*—Brinks Hofer Gilson & Lione

(57) ABSTRACT

A knock down corrugated cardboard container includes flat unitary bottom panel adapted for support by a conventional pallet. The bottom panel includes partial, integral stub sidewalls and an integral, hinged panel defining a full height end wall and full height partial sidewalls. A pair of clips are received within slotted openings which are aligned when the end wall and sidewalls are upright and in position relative to the short sidewalls. A second full height end wall also includes partial, full height sidewalls disposed opposite the full height end panel. A removable top or closure completes the carton assembly.

20 Claims, 8 Drawing Sheets

KNOCK DOWN CONTAINER WITH INTEGRAL WALL

BACKGROUND OF THE INVENTION

The invention relates generally to knock down, corrugated cardboard containers and more particularly to a knock down, corrugated cardboard container having a bottom, an integral rear wall assembly having partial sidewalls, removable retaining clips and a removable front wall assembly. Because the knock down height of the carton is approximately one-fourth to one-fifth the height of the assembled container, it may be efficiently stored in this condition and is readily assembled and reused.

Shipping easily damaged components such as glass lights or motor vehicle body parts to assemblers often requires containers constructed from heavy, rigid and relatively expensive materials such as metal and wood which are not readily recyclable and because of their size and weight are not efficiently returned for re-use. These containers are generally loaded and shipped from a component manufacturing facility to an assembly facility where they are unloaded. When rigid and constructed from permanent or non-recyclable materials, the containers also occupy storage space at both the manufacturing facility before they are filled and the assembly facility after they are emptied.

If the containers are to be reused, they are often shipped back to the manufacturing facility empty. Such deadheading is costly and wastes valuable space and resources, but is often unavoidable because many shipping containers are dedicated, i.e., are task specific, and thus unsuited for shipment of other articles. The expense of deadheading can be reduced by utilizing the container for shipment on the return trip, or eliminated by recycling the container or disposing of it. All of these options have drawbacks, however.

Disposable containers, since they are intended for a single use, are typically constructed from inexpensive materials. Such containers also tend to utilize an absolute minimum of material. Accordingly, with some regularity, they do not provide sufficient protection for their contents. Their reduced cost may thus be offset by increased damage to the shipped goods.

Recyclable containers are constructed from materials that are inexpensive and either uniform or diverse but compatible from a recycling standpoint. If any non-compatible or non-recyclable material is used, it should be easily separable from the recyclable portions of the container. If it is not, it may significantly raise the cost of recycling or effectively render the container non-recyclable.

Another frequently encountered problem, noted above, relates simply to the space occupied by empty containers. Typical cartons and boxlike containers are stored either fully assembled or, if so designed, in a disassembled or broken down state. Containers stored in a fully assembled state occupy large amounts of space. Containers stored in a disassembled state may require significant time and effort to assemble, thereby increasing the overall cost of their use. Hence, improvements in containers that address minimal storage and return size as well as easy reuse and recyclability are desirable.

SUMMARY OF THE INVENTION

A knock down, corrugated cardboard container includes a flat unitary bottom panel adapted for support by a conventional pallet. The bottom panel includes partial, integral stub sidewalls and an integral, hinged panel defining a full height rear wall and full height partial sidewalls. A pair of retaining clips are received within slotted openings in the stub sidewalls and partial sidewalls which are aligned when the rear wall and partial sidewalls are upright and adjacent the stub sidewalls. A full height front wall disposed opposite the full height rear wall also includes partial, full height sidewalls. A removable top or closure completes the carton assembly.

DESCRIPTION OF THE PREFERRED EMBODIMENT

Figure 1:
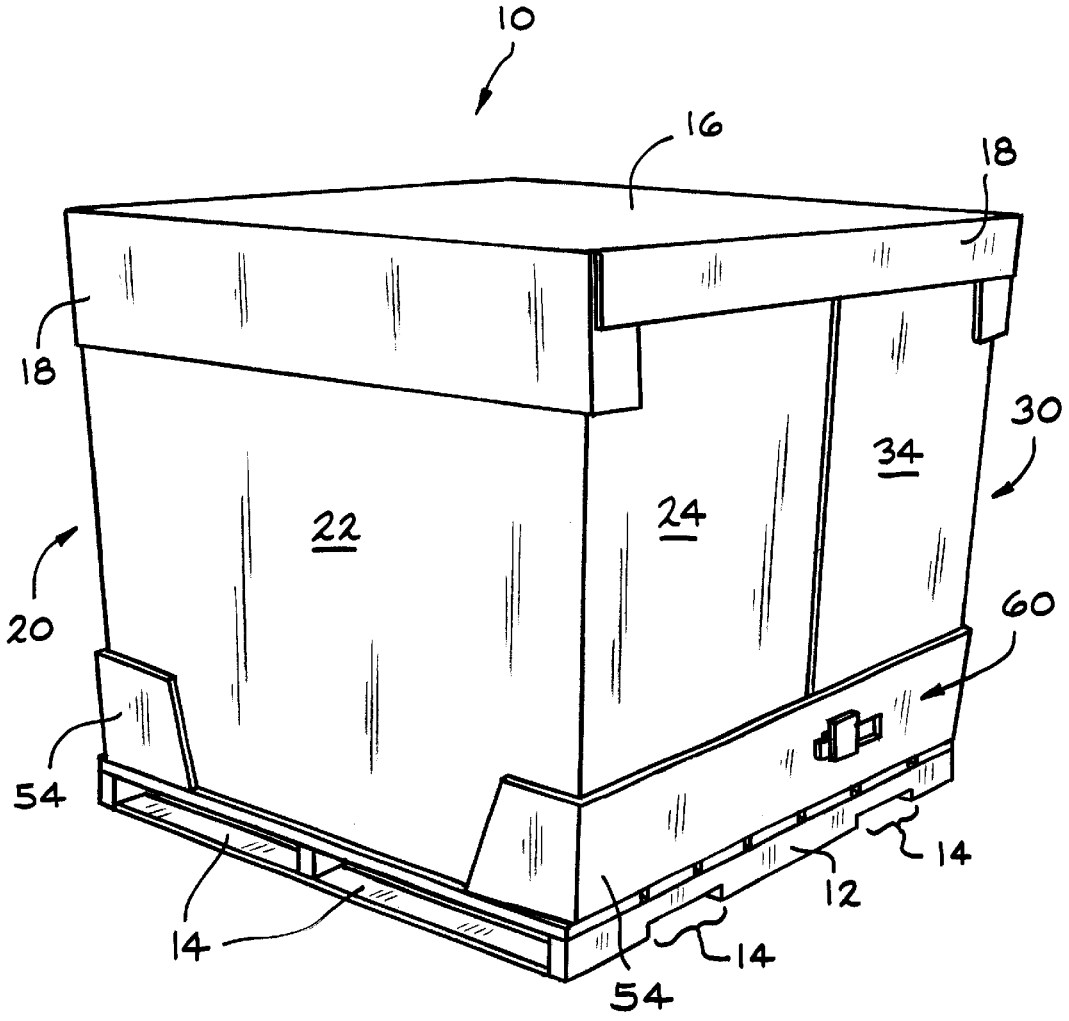
FIG. 1 is a perspective view of a knock down, corrugated cardboard container according to the present invention.

Referring now to FIG. 1, a knock down, corrugated container assembly having an integral wall according to the present invention is illustrated and generally designated by the reference number 10. The knock down container assembly 10 may most conveniently be supported upon a conventional pallet 12 having suitable openings 14 which may receive the forks of a forklift truck (not illustrated). The knock down container assembly 10 may be secured to the pallet 12 or it may simply rest thereupon.

The knock down corrugated container assembly 10 includes a single piece top, lid or closure 16 having folded and secured flaps 18 having a suitable interior size to receive the upright walls of the container assembly 10. Securement of the flaps 18 to one another may be achieved by staples, an adhesive or other suitable means. The container assembly 10 also includes a removable front and sidewall assembly 20 having a full height and full width front wall 22 and full height, left and right partial sidewalls 24. Generally symmetrically disposed relative to the removable front and sidewall assembly 20 is a hinged or pivoted rear and sidewall assembly 30. The rear and sidewall assembly 30 includes a full height and full width rear wall 32 and full height, left and right partial sidewalls 34. The left and right partial sidewalls 24 and 34 are sized to overlap on their respective sides at least two inches (5.1 cm) and preferably about four inches (10.1 cm).

Figure 2:
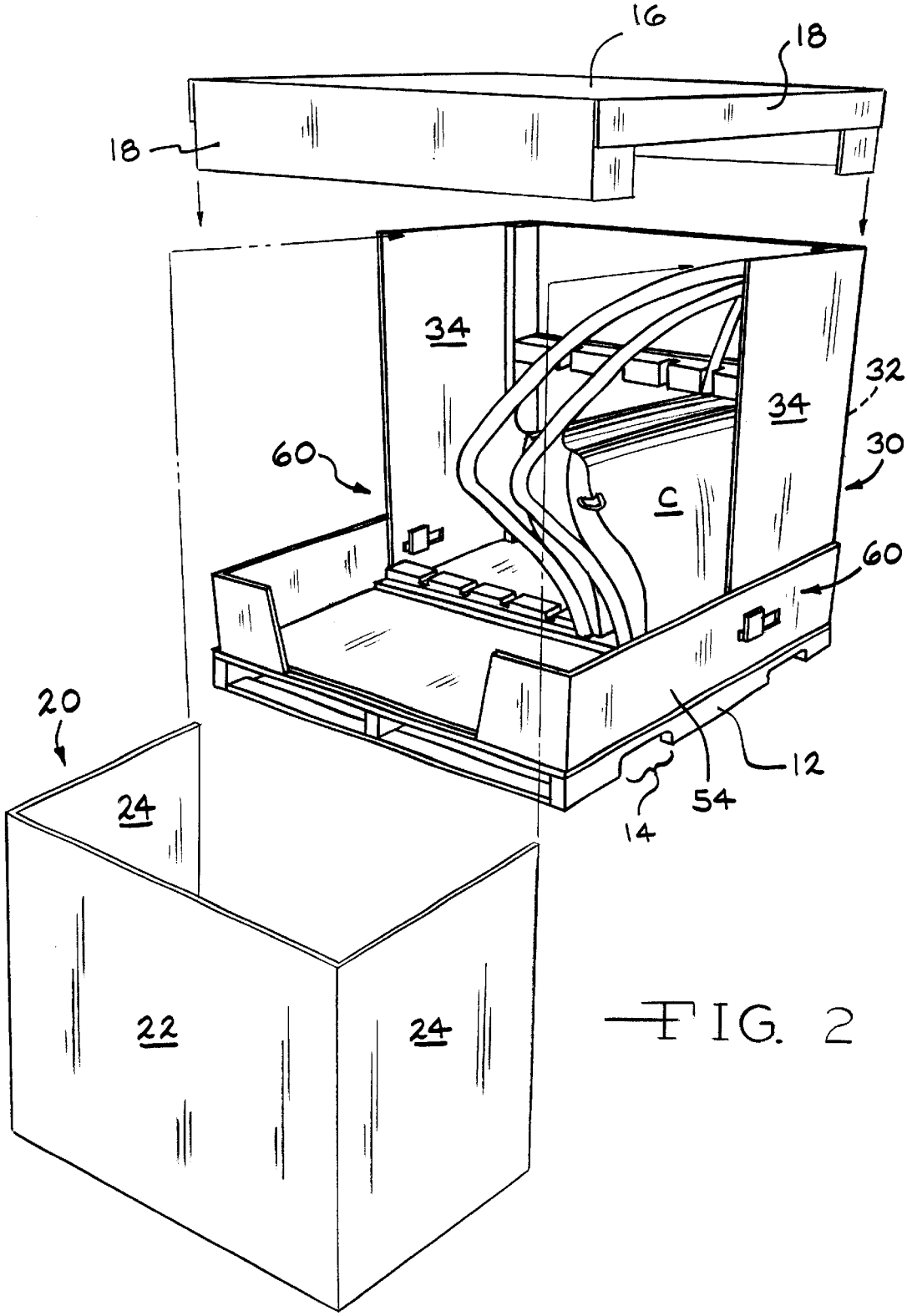
FIG. 2 is an exploded, perspective view of a knock down, corrugated container according to the present invention.
Figure 3:
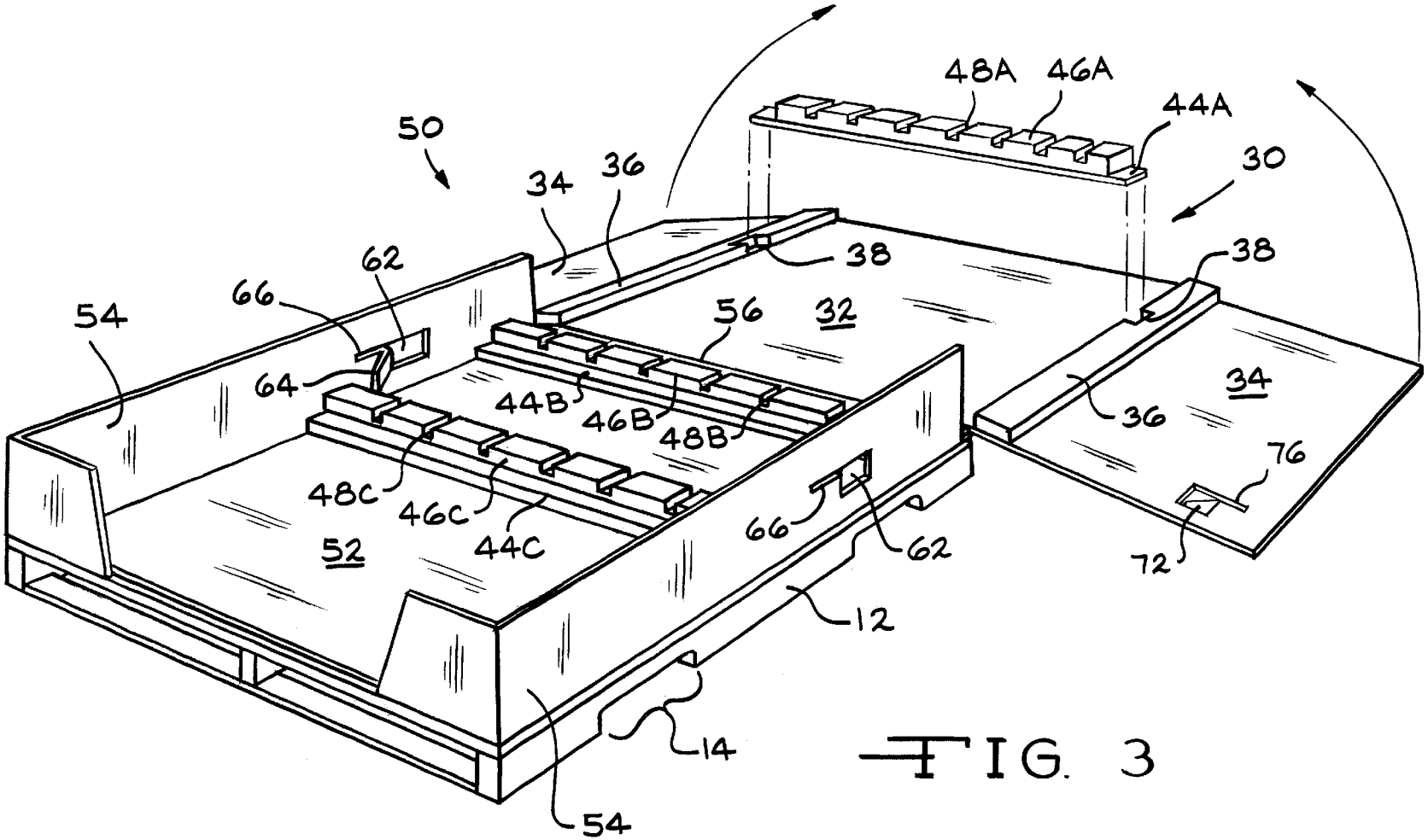
FIG. 3 is a perspective view of the integral bottom and sidewall components of a knock down, corrugated container according to the present invention in preassembly configuration.
Figure 4:
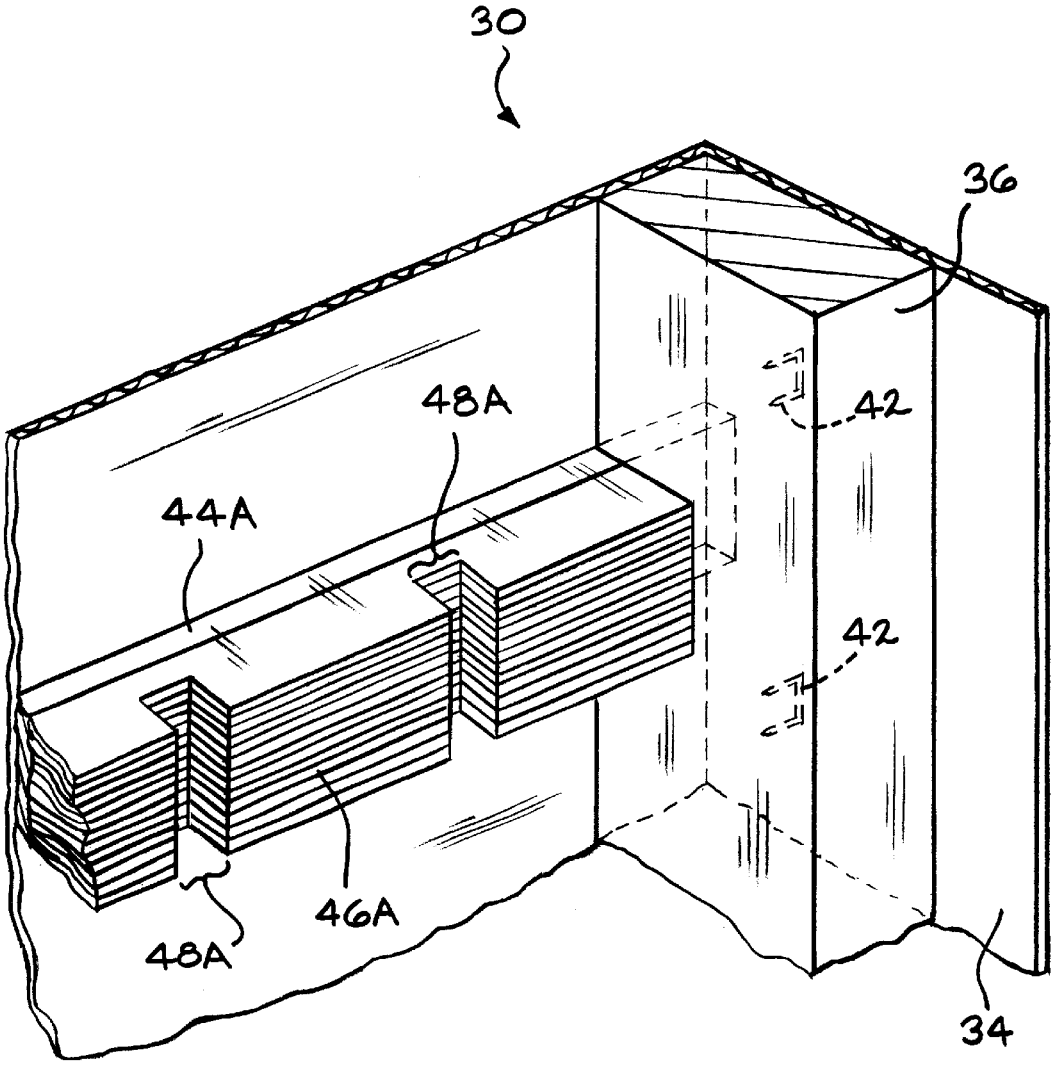
FIG. 4 is an enlarged, perspective view of a portion of a knock down, corrugated cardboard container according to the present invention illustrating the assembly of internal component receiving braces.

Referring now to FIGS. 2, 3 and 4, the left and right partial sidewalls 34 each include a preferably wood beam or support 36 defining at least one cutout or notch 38 which faces the rear wall 32. The beam or support 36 is preferably secured by suitable fasteners 42 such as the staples illustrated, brads, an adhesive, or other fastening device.

Preferably, the rear and side wall assembly 30 is integrally formed with a bottom assembly 50 having a bottom panel 52 and short or stub vertical sidewalls 54 that extend along the sides and front of the bottom panel 52. A live hinge 56 interconnects or couples the bottom panel 52 with the rear wall 32 to permit pivoting of the rear and side wall assembly 30 along a horizontal axis coincident with the rear edge of the bottom panel 52. Alternatively, if not integrally formed from a common sheet or panel of corrugated cardboard, the rear and sidewall assembly 30, and specifically the rear wall 32, may include a flexible or hinged tab (not illustrated) which may be secured through appropriate means to the bottom panel 52, or the bottom panel 52 may include a hinged tab (also not illustrated) which may be secured through appropriate means to the rear wall 32. As a further alternative, a hinge or flexible unitary live hinge (both not illustrated) may be secured to the bottom panel 52 and the rear wall 32.

The pair of notches 38 in the beams or supports 36 receive a horizontal beam or guide member 44A having a height and thickness complementary to the height and depth of the notches 38. The horizontal member 44A preferably includes an elongate block 46A which may be, for example, wood, fiberboard or built up adhered layers of corrugated cardboard defining a plurality of spaced apart notches 48A which are sized and spaced to receive a particular plurality of cargo such as glass panels, lights, doors, hoods, fenders, trunk lids, other body components, or other generally planar devices or components having relatively large height and width and relatively small thickness such that a plurality of such components may be placed and spaced apart within the interior of the corrugated container assembly 10.

Preferably secured to the bottom panel 52 in one, two or more locations, are additional guides beams or support members 44B and 44C which also include blocks of wood, fiberboard or built up corrugated material 46B and 46C which respectively define a plurality of spaced notches 48B and 48C. Once again, the spacing and size of the slots 48B and 48C as well as the number and placement of the support members 44B and 44C will be determined by the number and configuration of the cargo or other components to be placed within the container assembly 10, as will be readily appreciated. It should be noted, however, that whereas the horizontal guide member 44A is removably disposed within the container assembly 10, the support members 44B and 44C are preferably attached by adhesive, staples, brads or other suitable fasteners (all not illustrated). It will be appreciated that support, positioning and brace members distinct from those illustrated herein may be used with the present invention and that the support members 44A, 44B and 44C described are provided by way of example and illustration only. They may be varied widely in construction, location and number to accommodate diverse cargo. They may also be eliminated if the cargo does not require them or benefit from their use.

Figure 5:
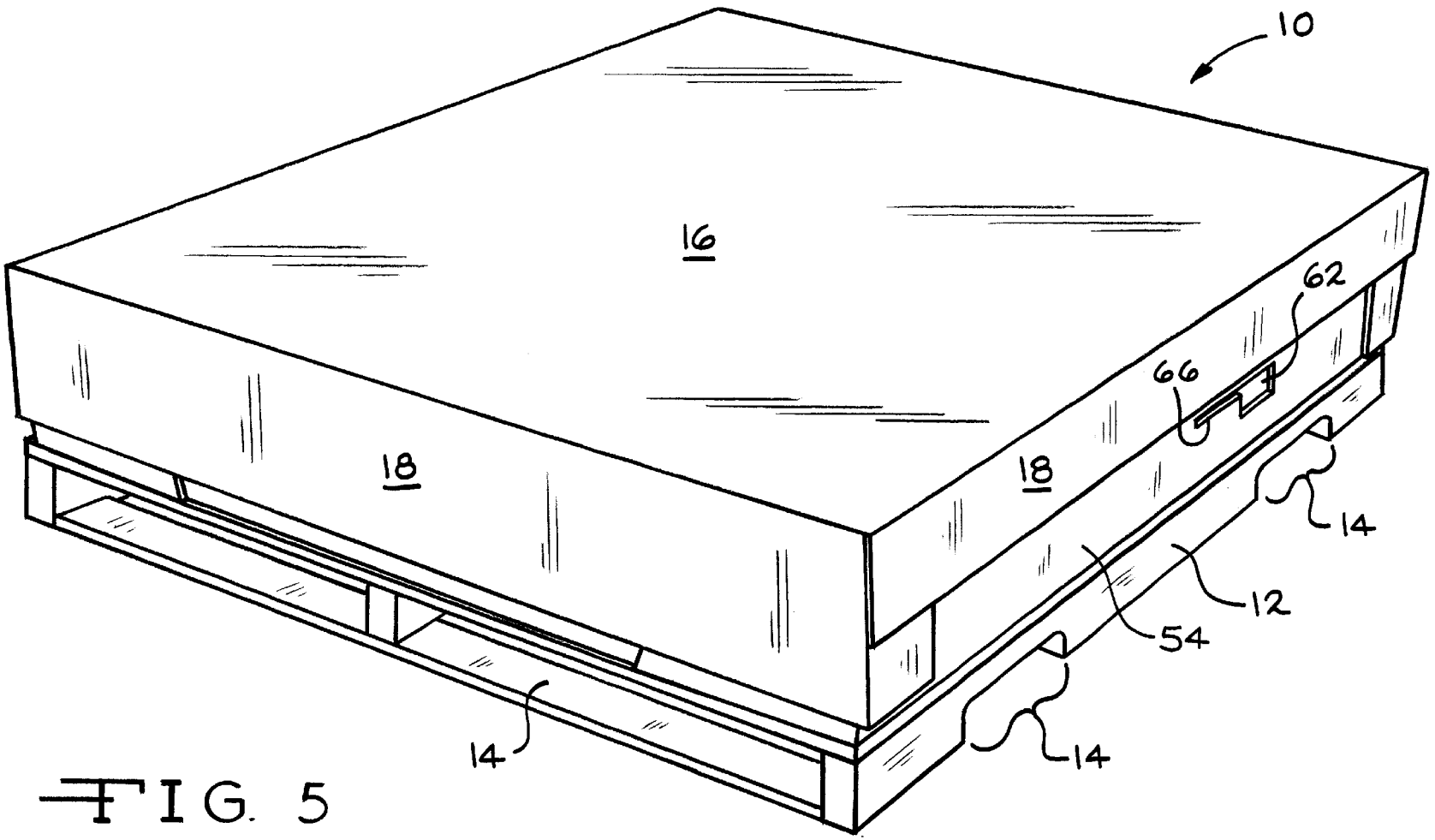
FIG. 5 is a perspective view of a knock down, corrugated cardboard container according to the present invention in its knocked-down condition.

FIG. 5 illustrates the knock down container assembly 10 in its fully knocked down or stowed condition. It will be appreciated that the knocked down height of the container assembly 10 is determined by the height of the pallet assembly 12, the stub sidewalls 54 and the top or closure 16 and that such height will nominally be between one fourth and one fifth the assembled or erected height of the container assembly 10 as illustrated in FIG. 1. It should also be appreciated that both the removable front and sidewall assembly 20 and the hinged rear and sidewall assembly 30 as well as any support members, such as the members 44A, 44B and 44C are received and stowable within the container assembly 10 as defined by the stub sidewalls 54. In order to achieve this, however, the height of the container assembly 10, i.e., the height of the front wall 22, the sidewalls 24, the rear wall 32 and the sidewalls 34 must not be greater than and is preferably somewhat less than the depth (front to rear distance) of the bottom panel 52 or they will not fit with the stub sidewalls 54 or the top or closure 16.

Referring now to FIGS. 2, 3, 6, 7 and 8, it will be appreciated that the knock down, corrugated cardboard container assembly 10 of the present invention also includes a pair of retainer or latch assemblies 60. The latch assemblies 60 include a pair of rectangular openings 62 in each of the short or stub sidewalls 54. The cut out material from the rectangular openings 62 define hinged tabs 64 which are folded outwardly. At the upper corner of the rectangular openings 62 most distant the rear wall 32 are narrow horizontal slots 66 which communicate with the rectangular openings 62.

The full height partial sidewalls 34 of the rear and sidewall assembly 30 include similarly disposed and oriented rectangular openings 72. The cut out material from the rectangular openings 72 defines hinged tabs 74. At the upper corner of the rectangular openings 72 most distant the support beams or members 36 are narrow horizontal slots 76 which communicate with the rectangular openings 72.

The retainer or latch assemblies 60 also include retaining clips 80 which may preferably be a plastic or metal extrusion having front and rear plates or panels 82 and 84 which are interconnected by a medially disposed web 86. The front and rear panels 82 and 84 define upper and lower channels 88A and 88B which have a width approximately equal to three thicknesses of the corrugated cardboard material utilized in the fabrication of the container assembly 10 according to the present invention and particularly the stub sidewalls 54 and the full height partial sidewalls 34 of the rear and sidewall assembly 30.

Figure 6:
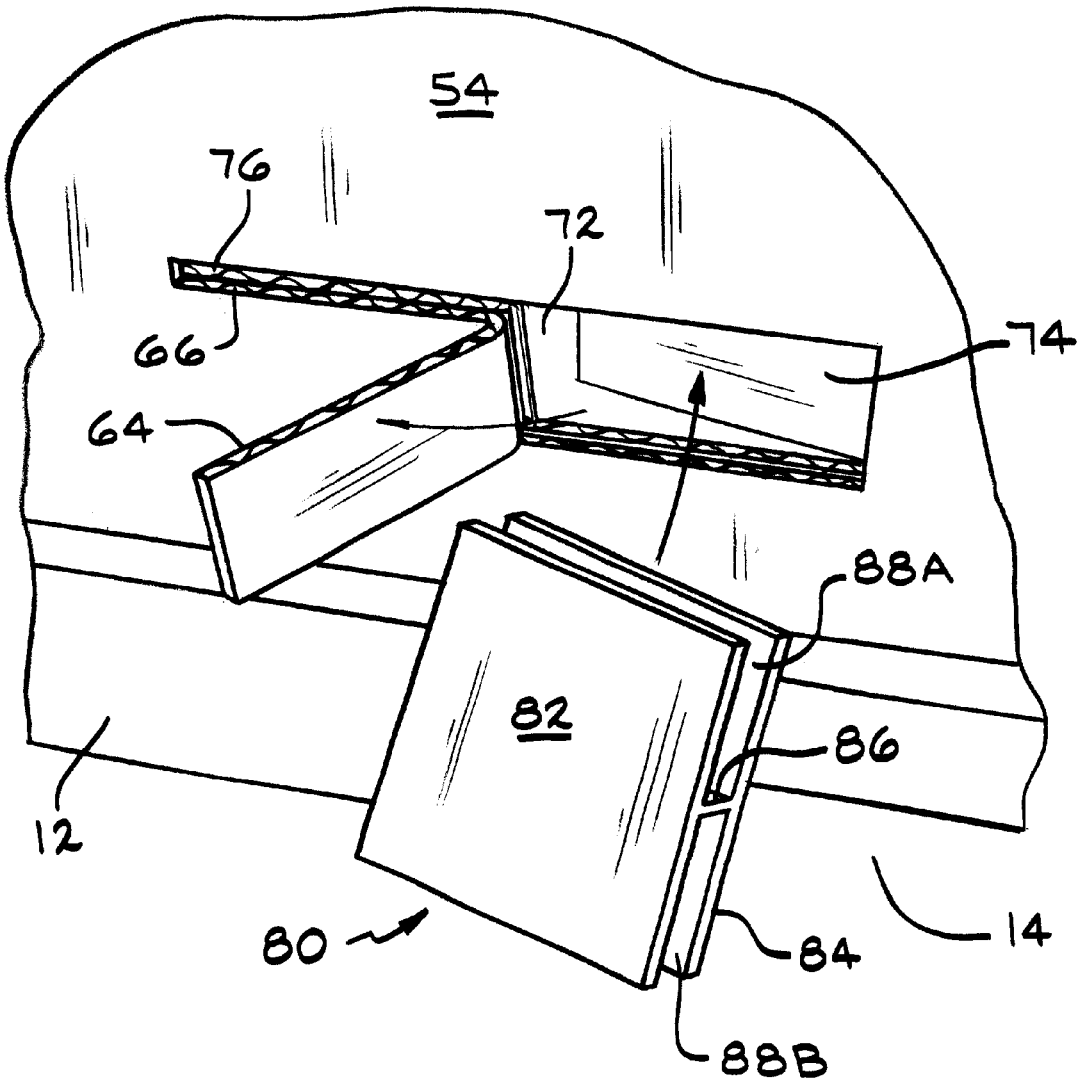
FIG. 6 is an enlarged, fragmentary perspective view illustrating the first step relating to the insertion of a retaining clip.
Figure 7:
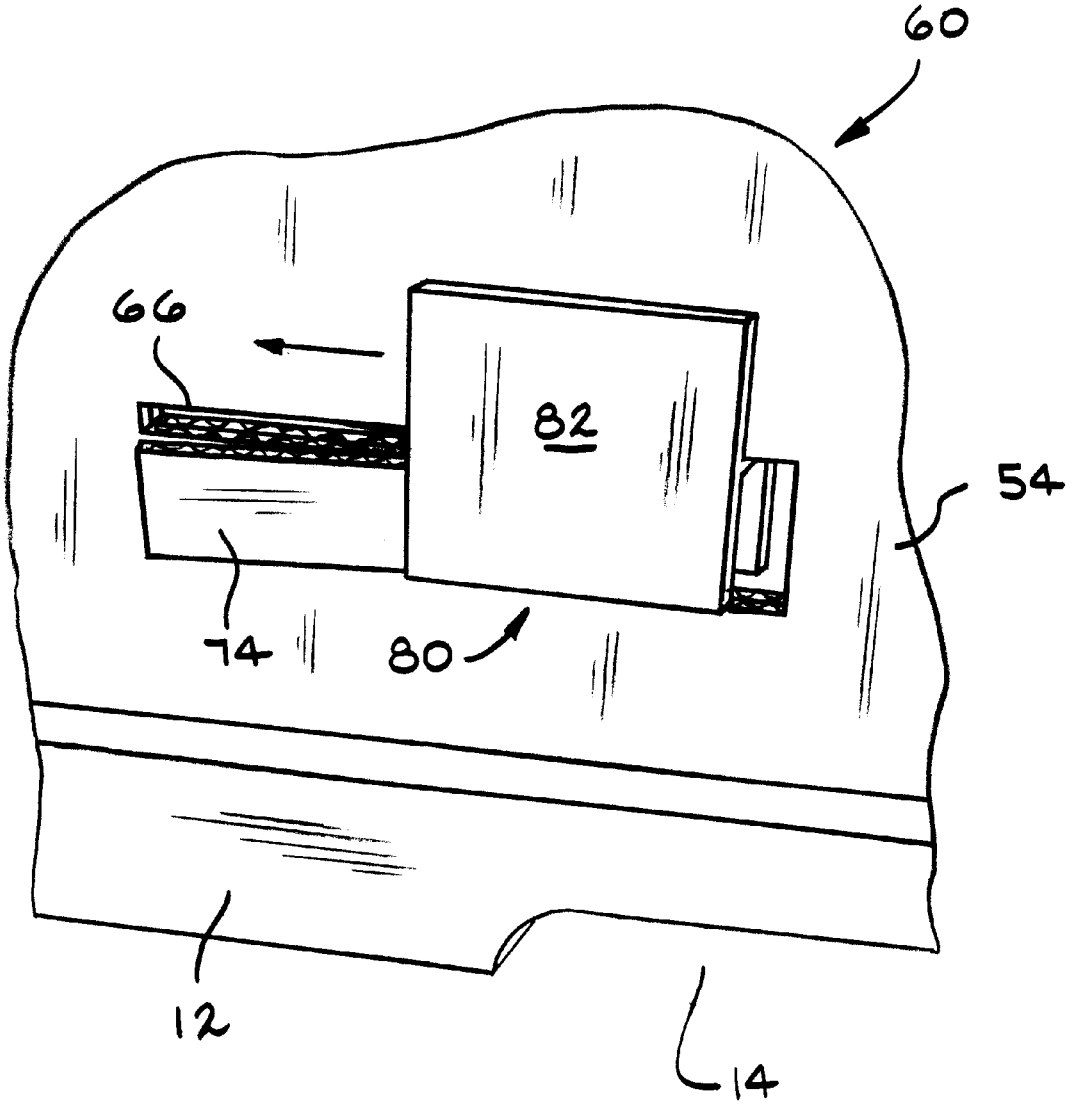
FIG. 7 is an enlarged, fragmentary, perspective view of the second step relating to the installation of the retaining clip.
Figure 8:
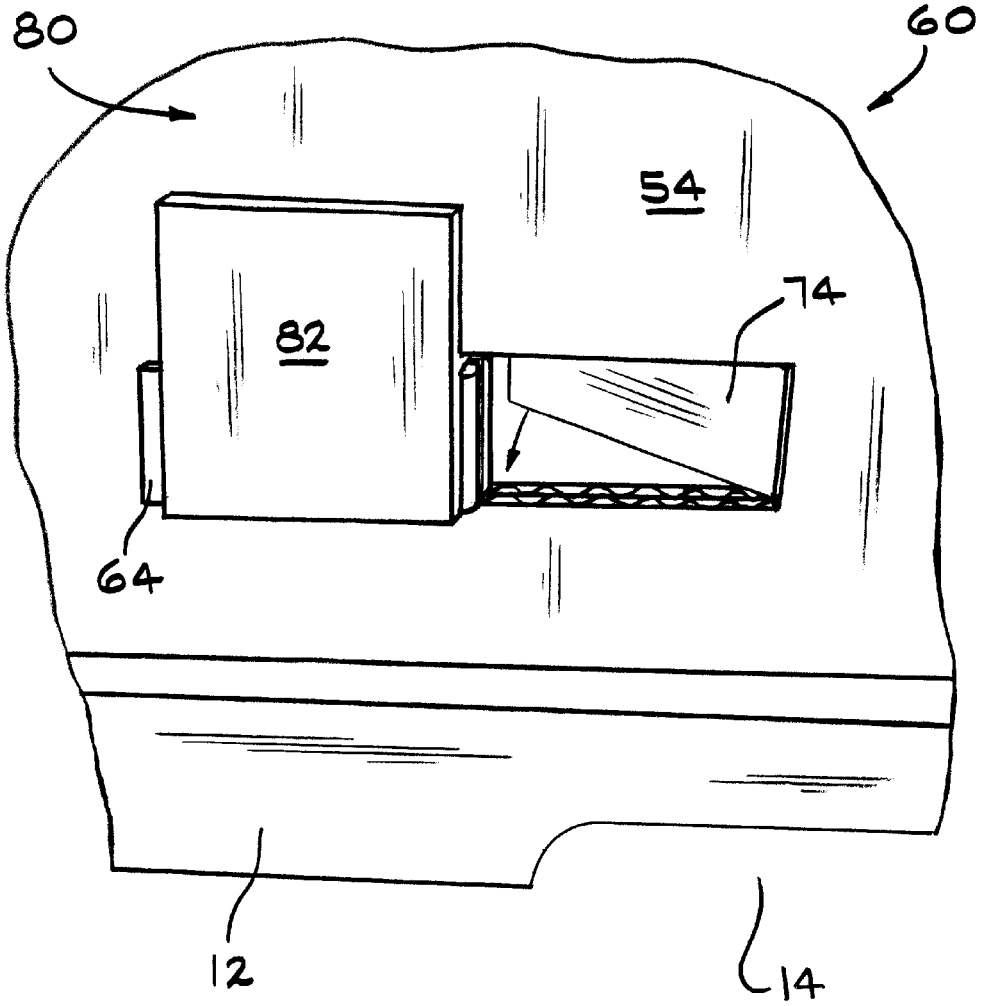
FIG. 8 is an enlarged, fragmentary, perspective view of the final step relating to the installation of the retaining clip.

Installation of the retaining clips 80 is best understood from a study of FIGS. 2, 6, 7 and 8. The rear and sidewall assemblies 30 and particularly the full height partial sidewalls 34 are installed inside the short or stub sidewalls 54 and positioned upright as illustrated in FIG. 2. Then, as illustrated in FIG. 6, the tabs 64 and 74 of the retaining assemblies 60 are moved out of the way such that the upper channel 88A of the retaining clip 80 may be slid into the aligned rectangular openings 62 and 72 such that the upper channel 88 engages and receives the stub sidewall 54 and the partial full height sidewall 34. As illustrated in FIG. 7, the tab 74 is folded back against the stub sidewall 54 and the web 86 of the retaining clip 80 is aligned with the aligned horizontal slots 66 and 76. Then, and as illustrated in FIG. 7, the retaining clip 80 is slid to the left, toward the front of the container assembly 10, along the stub sidewall 54 and the partial full height sidewall 34 such that the retaining clip 80 is moved fully forward to the left as illustrated in FIG. 8, to the end of the aligned horizontal slots 66 and 76. At this time, the rectangular flap 74 may be positioned in alignment with the full height partial sidewall 34 to close off the aperture 72. Then, components such as the frames C may be installed into the notches 48A, 48B and 48C. Next, the front and sidewall panel assembly 20 may be positioned within the partial or stub sidewalls 54 generally opposite the rear and sidewall assembly 30. Finally, the top or closure 16 may be placed upon the assemblies 20 and 30 to complete and close the carton assembly 10. The completed container assembly then appears as illustrated in FIG. 1. To knock down the container assembly 10, the steps illustrated in the drawings figures are undertaken in reverse.

The foregoing disclosure is the best mode devised by the inventors for practicing this invention. It is apparent, however, that products incorporating modifications and variations will be obvious to one skilled in the art of reusable containers. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

What is claimed is:

1. A knock down container comprising, in combination, a bottom assembly having a bottom panel and partial height sidewalls each defining a clip receiving opening, a rear assembly having a rear wall and a rear pair of partial sidewalls, said rear assembly flexibly secured to said bottom assembly and said partial sidewalls each defining a clip receiving opening, a pair of retaining clips for disposition in said openings, a front assembly having a front wall and a front pair of partial sidewalls, and a closure for disposition on said partial sidewalls.

2. The knock down container of claim 1 wherein said partial height sidewalls are between about one-fourth and one-fifth an assembled height of said container.

3. The knock down container of claim 1 wherein said clip receiving openings define a cutout region and a slot communicating with said cutout region.

4. The knock down container of claim 1 wherein said clip receiving openings are aligned when said rear pair of partial sidewalls are disposed in an upright position adjacent said partial height sidewalls of said bottom assembly.

5. The knock down container of claim 1 wherein said rear assembly is integral with said bottom assembly.

6. The knock down container of claim 1 wherein said rear wall of said rear assembly and said bottom panel of said bottom assembly are secured together by a live hinge.

7. The knock down container of claim 1 further including a pallet and wherein said bottom assembly is disposed upon said pallet.

8. The knock down container of claim 1 wherein said rear pair of partial sidewalls and said front pair of partial sidewalls define a full height of said container.

9. A knock down container comprising, in combination, a bottom assembly having a bottom panel and a partial height sidewall defining a clip receiving opening, a rear assembly having a rear wall and a pair of partial sidewalls, said rear assembly flexibly secured to said bottom assembly, and said pair of partial sidewalls each defining a clip receiving opening, a pair of retaining clips adapted for disposition in said openings, and a front assembly having a front wall and a pair of partial sidewalls, whereby said pair of partial sidewalls of said rear assembly may be secured to said partial height sidewalls of said bottom assembly by said pair of retaining clips and said front assembly may be disposed on said bottom assembly opposite said rear assembly.

10. The knock down container of claim 9 wherein said partial height sidewalls extend along a portion of a front of said bottom assembly.

11. The knock down container of claim 9 wherein said clip receiving openings define a cutout region and a slot communicating with said cutout region.

12. The knock down container of claim 9 wherein said clip receiving openings are aligned when said pair of partial sidewalls of said rear assembly are disposed in an upright position adjacent said partial height sidewalls of said bottom assembly.

13. The knock down container of claim 9 wherein said rear assembly is integral with said bottom assembly.

14. The knock down container of claim 9 wherein said rear wall of said rear assembly and said bottom panel of said bottom assembly are secured together by a live hinge.

15. A knock down container comprising, in combination, a bottom assembly having a bottom panel and a partial height sidewall defining a first pair of clip receiving openings, a rear assembly having a rear wall and a pair of partial sidewalls, said rear wall of said rear assembly hingedly secured to said bottom panel of said bottom assembly, said partial sidewalls defining a second pair of clip receiving openings, a pair of retaining clips adapted to for disposition in said openings, a front assembly disposed on said bottom assembly and having a front wall disposed opposite said rear wall and partial sidewalls disposed parallel to and partially adjacent said partial sidewalls of said rear assembly, and a lid adapted for disposition on walls and sidewalls.

16. The knock down container of claim 15 wherein said partial height sidewall extends along a portion of a front of said bottom assembly.

17. The knock down container of claim 15 wherein said clip receiving openings define a cutout region and a slot communicating with said cutout region.

18. The knock down container of claim 15 wherein said clip receiving openings are aligned when said partial sidewalls of said rear assembly are disposed in an upright position adjacent said partial height sidewall of said bottom assembly.

19. The knock down container of claim 15 wherein said rear assembly is integral with said bottom assembly.

20. The knock down container of claim 15 wherein said rear wall of said rear assembly and said bottom panel of said bottom assembly are secured together by a live hinge.

* * * * *